US005685880A

United States Patent [19]

Masutani et al.

[11] Patent Number: 5,685,880

[45] Date of Patent: Nov. 11, 1997

[54] LEATHER MODIFIER, PROCESS FOR MODIFYING LEATHER AND MODIFIED TANNED LEATHER

[75] Inventors: Tetsuya Masutani; Masato Kuroi; Yasuo Itami; Masahiko Maeda; Norio Yanagisawa; Yoshihiko Misugi; Maki Yasuhara, all of Settsu, Japan

[73] Assignee: Daikin Industries, Ltd., Osaka, Japan

[21] Appl. No.: 232,434

[22] Filed: Apr. 21, 1994

Related U.S. Application Data

[63] Continuation of Ser. No. 812,265, Dec. 23, 1991, abandoned.

[30] Foreign Application Priority Data

Dec. 25, 1990 [JP] Japan ..... 2-405798

[51] Int. Cl.[6] ..... C14C 9/00

[52] U.S. Cl. ..... 8/94.22; 8/94.21; 8/94.23; 252/8.57; 558/177; 558/105; 558/175

[58] Field of Search ..... 8/94.21, 94.22, 8/94.23, 94.19 R, 94.19 C, 94.33; 558/177, 105, 175; 427/389, 384; 252/8.57

[56] References Cited

U.S. PATENT DOCUMENTS

| | | | |
|---|---|---|---|
| 2,723,971 | 11/1955 | Cupery | 8/94.21 |
| 3,094,547 | 6/1963 | Heine | 8/115.6 |
| 3,096,207 | 7/1963 | Cohen . | |
| 3,919,361 | 11/1975 | Katsushima et al. | 558/177 |
| 4,029,722 | 6/1977 | Demarcq et al. | 558/177 |
| 4,828,570 | 5/1989 | Riegel et al. | 8/94.21 |

FOREIGN PATENT DOCUMENTS

| | | |
|---|---|---|
| 2203119 | 8/1973 | Germany . |
| 59-104353 | 6/1984 | Japan . |
| 2-215900 | 8/1990 | Japan . |
| 421083 | 3/1967 | Switzerland . |

OTHER PUBLICATIONS

Article entitled "An Interfacial Chemical Approach to Fatliquoring Effect on Leather", by Kyoji Sato et al., from Leather Chemistry, vol. 34, No. 3, pp. 107–115 (1988), (Month Unknown).

*Primary Examiner*—Alan Diamond
*Attorney, Agent, or Firm*—Birch, Stewart, Kolasch & Birch, LLP

[57] ABSTRACT

A leather modifier containing a compound which is obtainable through a reaction of an ethylene oxide derivative having a fluorine-containing group with a phosphorus compound is disclosed. A leather treated with the modifier has much improved properties.

13 Claims, No Drawings

LEATHER MODIFIER, PROCESS FOR MODIFYING LEATHER AND MODIFIED TANNED LEATHER

This application is a continuation, of application Ser. No. 07/812,265 filed on Dec. 23, 1991, now abandoned.

BACKGROUND OF THE INVENTION

1. Field of the Invention

The present invention relates to a leather modifier, a process for modifying leather and a modified tanned leather. More particularly, the present invention relates to a leather modifier comprising a fluorine-containing phosphorus compound, a process for modifying leather comprising treating a tanned leather with a leather modifier in a step for fatting the leather, and a tanned leather modified by said process.

2. Description of the Related Art

A process for producing a leather comprises steps of pretreatment, tanning and finishing. The finishing step includes treatment with a fatting agent and top finish.

The tanning step herein used means treatment of the leather with a widely used inorganic or mineral tanning agent such as a chromium base tanning agent, an aluminum base tanning agent and a zirconium base tanning agent, and includes treatment of the leather with a metal which can form a complex ion. A chromium-tanned leather is one of typical tanned leathers and has excellent flexibility, elasticity, tensile strength, heat resistance and dye-affinity.

Recently, irrespective of kinds of leather, tanned leathers for clothes, furniture, insteps of shoes, gloves and the like are not finished or are slightly finished. Thereby, a tanned leather having inherent touch, surface, appearance and feeling of natural leather can be obtained.

However, elimination of the finishing results in serious drawbacks as increase of water absorbance, decrease of water-proofing caused by formation of water droplets, or decrease of stain-proofing against oils. These drawbacks may be obstacles in practical use, for example, in view of repair of leather goods.

To overcome the drawbacks of the tanned leather, various fatting agents are used in the fatting step to protect the leather fibers from water or chemicals (hydrophobic treatments), and to improve the properties of the leather such as touch, puff, gloss, flexibility and other appearance.

In addition, to increase water- and oil-repellency of the leather, a fluorine-containing compound is conventionally used, and various fluoroacrylate polymers, fluorocarboxylic acids and their chromium complex, and fluoroalkyl phosphates are used.

The fatting effects cannot be achieved by the conventional fatting agents without adversely affecting the appearance, touch, feeling, flexibility, air-permeability and other desirable properties.

SUMMARY OF THE INVENTION

An object of the present invention is to provide a tanned leather which has improved properties such as shrink proofing, color fastness, weather resistance, color fastness to rubbing and deep color effect, as well as durable water- and oil-repellency, natural feeling and flexibility without finishing.

Another object of the present invention is to provide a leather modifier which can provide a tanned leather which has improved properties such as shrink proofing, color fastness, weather resistance, color fastness to rubbing and deep color effect, as well as durable water- and oil-repellency, natural feeling and flexibility without finishing.

A further object of the present invention is to provide a process for modifying a tanned leather to give a tanned leather which has improved properties such as shrink proofing, color fastness, weather resistance, color fastness to rubbing and deep color effect, as well as durable water- and oil-repellency, natural feeling and flexibility without finishing.

According to the first aspect of the present invention, there is provided a leather modifier comprising a compound which is obtainable through a reaction of an ethylene oxide derivative having a fluorine-containing group with a phosphorus compound.

According to the second aspect of the present invention, there is provided a process for modifying a leather, which comprises tanning a leather and treating the tanned leather with a leather modifier of the present invention in place of or in combination with a fatting agent.

According to the third aspect of the present invention, there is provided a modified tanned leather which has been treated with a leather modifier of the present invention in place of or in combination with a fatting agent.

DETAILED DESCRIPTION OF THE INVENTION

In the present invention, the fluorine-containing organic group which may be represented by the formula: $R_f$ is intended to mean, in general, a fluorine-containing aliphatic group such as a saturated or unsaturated, straight or branched fluorine-containing aliphatic group. The carbon atoms in the group may be interrupted by an oxygen atom. That is, the group may have at least one ether linkage.

The ethylene oxide derivative having the fluorine-containing group to be used in the present invention is preferably represented by the following formula:

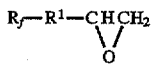

(I)

wherein $R_f$ is a $C_3$–$C_{21}$ fluoroalkyl group, fluoroalkenyl group or fluoroether group or a mixture thereof; and $R^1$ is a group of the formula:

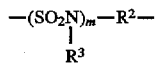

wherein $R^2$ is a $C_1$–$C_{20}$ alkylene group or a group having a phenyl group which may have a double or triple bond or an ether linkage at an arbitrary position therein, or it may form a ring, and any hydrogen atom bonded to a carbon atom of $R^2$ may be substituted with a halogen atom; $R^3$ is a $C_1$–$C_5$ alkyl or hydroxyalkyl group; and m is 0 or 1.

Specific examples of the ethylene oxide derivative (I) are

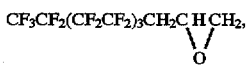

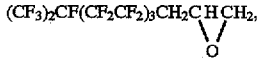

-continued

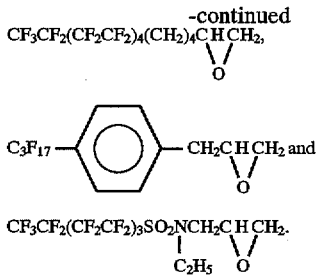

Examples of the phosphorus compound are pyrophosphoric acid, polyphosphoric acid, metaphosphoric acid, phosphorus pentoxide, and the like.

The reaction is carried out by heating a mixture of the ethylene oxide derivative and the phosphorus compound while stirring. A reaction temperature is usually from 30° to 200° C., preferably from 50° to 150° C., and a reaction time is usually from 0.5 to 15 hours, preferably from 1 to 8 hours. An amount of the ethylene oxide derivative is from 0.3 to 3 moles, preferably from 0.6 to 2 moles per one mole of the phosphorus atom.

The reaction product mainly contains the compounds of the formulas (II), (III) and (IV). Also, the compounds of the formulas (V) and (VI) are present:

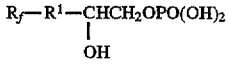

(II)

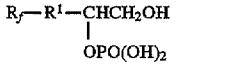

(III)

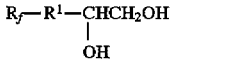

(IV)

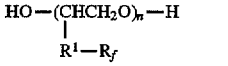

(V)

(n is an integer of 2 or larger)

Phosphate esters of the compound (V) (VI)

wherein $R_f$ and $R^1$ are the same as defined above.

The leather modifier of the present invention contains, as an active ingredient, at least one of the above compounds in an amount of 5 to 95% by weight based on the whole weight of the modifier. In addition to the above active compound, the leather modifier of the present invention contains a surfactant, a neutral oil, water and the like. Optionally, the leather modifier may contain other known additives such as a preservative.

The modification of leather with the leather modifier of the present invention is carried out in the fatting step in an aqueous bath with using 100 to 200% by weight of the leather modifier of the present invention and optionally the fatting agent based on the weight of the leather at a temperature of 20° to 60° C. for 30 to 90 minutes.

The leather to be modified according to the present invention may be any leather which has been tanned with a conventional metal base tanning agent such as a chromium, zirconium or aluminum base tanning agent or retanned with an organic or inorganic tanning agent. The leather may be cow hide, ox hide pig skin, sheep skin, goat skin, horse hide and the like as well as suede.

It may be expected that the finishing of the leather would be difficult if the leather were treated with a compound having the $R_f$ group, since the surface energy of the leather is lowered with the $R_f$ group. When the leather is treated with the leather modifier of the present invention, the leather has ideal properties without finishing.

In the fatting step, when the leather modifier of the present invention comprising the above compound is used in place of or in addition to the fatting agent, the hydroxyl group bonded to the phosphorus atom in the formula (II) or (III) forms a coordinate bond with the metal (e.g. chromium) ion and the compound is bonded to the leather fibers. The mechanism for the bonding of the leather modifier with the leather fibers may be the same as that in case of a monoalkyl phosphate (MAP) as described by Sato et al. in "Fatting Effects from the View Point of Surface Chemistry", Hikaku-Kagaku (Leather Chemistry), 34(3), 107–115 (1988). Accordingly, on the surface of the leather, the long chain fluorine-containing groups are oriented, whereby the surface energy of the leather is lowered, water- and oil-repellency is imparted to the leather.

As already explained, the fluoroalkyl phosphate is known as a modifier of the chromium tanned leather (cf. Japanese Patent Kokai Publication Nos. 104353/1984 and 215900/1990 and U.S. Pat. No. 3,096,207). However, such modifier cannot impart sufficient water- and oil-repellency to the leather and deteriorates the touch and feeling of the leather which are most important properties of the leather. Therefore, such modifier is not practically attractive.

The reaction product according to the present invention contains the diol (IV) and the compounds (V) and (IV) in addition to the phosphorus compounds (II) and (III), these compounds synergistically improves the finishing effects of the leather, in particular, the touch and feeling are greatly improved, and the leather becomes flexible. Of course, the water- and oil-repellency is not deteriorated, and is rather improved. In addition, color fading which may have caused by the conventional finishing agent can be prevented by the leather modifier of the present invention.

An additional characteristics of the present invention is that the finishing of the leather can be avoided. That is, when the leather which is treated with the conventional modifier is not finished, the leather goods should be repaired since the fatting with the conventional fatting agent cannot impart the water resistance and the soil proofing to the leather. Further, when the leather is finished with the conventional finishing agent, it is difficult to maintain the original surface properties, touch and flexibility of the leather while maintaining air permeability. Finally, such treatment cannot be applied to suede finished leather.

After the treatment with the leather modifier of the present invention, the leather may be finished by a conventional manner, if desired.

The leather modified with the leather modifier of the present invention can be used in the same fields as the conventional leather. For example, the modified leather can be used for assembling or producing clothes, furniture, shoes, gloves and the like.

The leather modified with the leather modifier of the present invention does not suffer from the so-called color fading and has improved properties such as shrink proofing, color fastness, weather resistance, color fastness to rubbing and deep color effect. In addition, it has durable water- and oil-repellency, natural feeling and flexibility. According to the present invention, the finishing of the leather can be neglected.

PREFERRED EMBODIMENTS OF THE INVENTION

The present invention will be illustrated by following Examples.

A shaved chromium-tanned cow hide was treated with a leather modifier which was prepared by reacting the ethylene oxide derivative and the phosphorus compound according to the present invention and then subjected to the various tests. For comparison, a leather which had been treated with a fatting agent outside the present invention and a leather which had been impregnated with a fluoroalkyl group-containing acryl copolymer were used.

EXAMPLE 1

Preparation of Sample Modifiers

As an active ingredient, a test compound of the present invention which was prepared by reacting the ethylene oxide derivative having the fluorine-containing group with the phosphorus compound, or comparative polyfluoroalkyl phosphate or monoalkyl phosphate (MAP) was mixed with the following compounds to prepare a sample modifier.

0.01 to 50% by weight of the active ingredient 0 to 50% by weight of an silicone oil 50 to 99.99% by weight of aqueous ammonia.

Test compound and fatting agents (1) A reaction product of

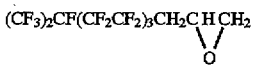

with pyrophosphoric acid.

(2) A mixture of the compounds (a) and (b) in a weight ratio of 70:30;

(a): $(CF_3)_2CF(CF_2CF_2)_3CH_2CH(OH)CH_2OPO(OH)_2$

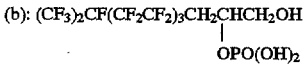

(3) $CF_3(CF_2)_7CH_2CH_2OPO(OH)_2$ (4) $C_{16}$-MAP (5) $C_7F_{15}COOH.NH_4$ (6) TG-620 (a fluoroalkyl group-containing acryl copolymer manufactured by Dakin Industries Ltd.)

EMB: (sulfonated oil base fatting agent manufactured by Hoechst AG).

Preparation of the Composition (1)

The above ethylene oxide derivative (52.6 g) was charged in a 200 ml four-necked flask and heated to 60° C. while stirring. Then pyrophosphoric acid (5.3 g) was added. An internal temperature rose to 120° C. After confirming decrease of the internal temperature to 100° C., the flask was again heated and the mixture was stirred at 110° to 115° C. for 3 hours to obtain the composition (1).

Preparation of the Mixture (2)

$(CF_3)_2CF(CF_2CF_2)_3CH_2CH(OH)CH_2OH$ (10 g) was dissolved in 1,1,2-trichloro-1,2,2-trifluoroethane (R-113). To the solution, phosphorus oxychloride (8.5 g) was dropwise added at 0° C. After the addition of phosphorus oxychloride, the mixture was warmed to room temperature and stirred, followed by evaporating off R-113 and excessive phosphorus oxychloride. The residue was dropwise added to a large amount of iced water. After stirring for 3 hours, a precipitated solid product was filtered and dried to obtain the mixture (2).

Preparation of the Compound (3)

Using $CF_3(CF_2)_7CH_2CH_2OH$ (10 g) and phosphorus oxychloride (9.9 g), the same procedures as in the preparation of the mixture (2) were repeated to obtain the compound (3).

EXAMPLE 2

Treatment Procedures of Chromium-tanned Leather

A chromium-tanned leather was treated as follows:

i) Washing with water and dewatering ii) Neutralization iii) Fatting and dewatering iv) Washing with water and dewatering v) Drying The treatment or processing of the leather with the leather modifier of the present invention can be carried out by the conventional method except that the leather modifier of the present invention is added to a wet processing drum in the wet processing step. That is, in the above treatment procedures, the steps ii) and iii) were carried out in a rotating drum.

The washing steps were carried out in flowing water. In the neutralization step, an aqueous solution of at least one neutralizing agent was added to the drum in about twice amount of the weight of the leather, and the drum was rotated at about 30° C. for about 60 minutes to adjust pH of the bath at 5.5 to 6.0. Examples of the neutralizing agent are ammonium formate, ammonium acetate, sodium carbonate, sodium bicarbonate, sodium formate and sodium acetate.

After neutralization, the bath liquid was drained, and the neutralized leather was removed from the drum and washed in flowing water sufficiently.

In the fatting step, each modifier containing the composition (1) and the mixture or the compound (2) to (5) in an amount of 6% by weight based on the leather weight and a neutral oil (e.g. liquid paraffin) in an amount of 1% by weight based on the leather weight were mixed with water in an amount of 1.5 times the leather weight.

Each mixture and the leather were charged in the drum and the drum was rotated at 50° C. for 60 minutes while keeping pH at 5.5 to 6.0.

Thereafter, the leather was washed with flowing water and dewatered followed by air drying in a room. The dried leather was subjected to the property tests in Example 3.

In case of the compound (6), the EMB treated leather was air dried, dipped in a 1.04% by weight solution of the compound (6) in n-heptane and then redried.

EXAMPLE 3

Evaluation of Properties of Leathers

With each leather treated in Example 2, its feeling, water-repellency, oil-repellency and water absorbance were evaluated.

a) Feeling

Hand feeling of the treated leather was evaluated by ten panels (five men and five women) according to the following criteria:

1: Vary stiff

3: Normal

5: Very soft

The results are as follows:

| Ingredient No. | (1) | (2) | (3) | (4) | (5) | EMB | EMB + (6) |
|---|---|---|---|---|---|---|---|
| Average of men | 4.2 | 3.3 | 2.5 | 4.0 | 2.5 | 3.1 | 2.9 |
| Average of women | 4.8 | 3.5 | 2.2 | 4.2 | 2.3 | 3.0 | 2.7 |

b) Water-repellency

Water-repellency of the treated leather was evaluated according to JIS L 1092-1977.

The results are as follows:

| Ingredient No. | (1) | (2) | (3) | (4) | (5) | EMB | EMB + (6) |
|---|---|---|---|---|---|---|---|
| On grain side | 95 | 80 | 90 | 60 | 50 | 0 | 100 |
| On flesh side | 100 | 95 | 85 | 70 | 70 | 50 | 100 |

c) Oil repellency

Oil-repellency of the treated leather was evaluated according to the AATTCC standard test 118-1972.

The results are as follows:

| Ingredient No. | (1) | (2) | (3) | (4) | (5) | EMB | EMB + (6) |
|---|---|---|---|---|---|---|---|
| On grain side | 4 | 2 | 0 | 0 | 0 | 0 | 3 |
| On flesh side | 4 | 4 | 4 | 0 | 0 | 0 | 3 |

d) Water absorbance

Water absorbance of the treated leather was evaluated according to JIS K-6550.

The results are as follows:

| Ingredient No | (1) | (2) | (3) | (4) | (5) | EMB | EMB + (6) |
|---|---|---|---|---|---|---|---|
| | 21 | 25 | 51 | 28 | 50 | 65 | 25 |

EXAMPLE 4

After shaving, the leather was dyed and neutralized as follows:

Washing thoroughly in flowing water
↓
Neutralization: Sodium formate, 1.5%
Sodium bicarbonate, 1.5%
Water, up to 100%
pH, 6
Drum rotation for 60 minutes
↓
Washing thoroughly in flowing water
↓
Dyeing: Luganil Black NT (BASF), 6%
Water, up to 100%
at 50° C.
Drum rotation for 60 minutes
Addition of 2% of formic acid and drum rotation for 10 minutes
Addition of 3% of Luganil Black NT and drum rotation for 30 minutes
↓
Washing thoroughly in flowing water -continued ↓
Retaining: Baychrom F (Bayer AG), 2%
Water, up to 100%
Drum rotation at 30° C. for 90 minutes
Kept standing overnight
↓
Washing with water
↓
Neutralization in the same manner as above
↓
Washing with water
↓
Fatting Thereafter, the leather was treated with the composition of the present invention (7) or the comparative compound or agents (8) to (11) according to the procedures in Table 1. Then, the leather sample Nos. 1 to 7 were subjected to the property tests.

Ingredient

Composition (7):

A reaction product of

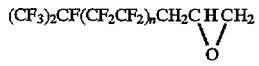

wherein n is an integer of 2 to 9, each compound being present in an amount of 5% by weight (n=2), 50% by weight (n=3), 24% by weight (n=4), 11% by weight (n=5), 4.5% by weight (n=6), 3.5% by weight (n=7), 1.5% by weight (n=8) and 0.5% by weight (n=9), with pyrophosphoric acid.

Compound (8):

$CF_3(CF_2)_7CH_2CH_2OPO(OH)_2$ (9) $C_{16}$-MAP

(10) Scotch Guard (trade mark) 233A (3M)

(11) HOEL (trade mark) 3740 (Hoechst AG)

(12) Cerrol (trade mark) M (Sandoz AG)

Preparation of the Composition (7)

In the same manner as in the preparation of the composition (1) in Example 1 but using the above ethylene oxide derivative mixture (60 g) and pyrophosphoric acid (5.3 g), the composition (7) was prepared.

TABLE 1

| Sample No. 1 | Sample No. 2 | Sample No. 3 | Sample No. 4 | Sample No. 5 | Sample No. 6 |
|---|---|---|---|---|---|
| Com. (7) 5% + $H_2F$ 1% | Comp'd (8) 5% + $H_2F$ 1% | Comp'd (9) 5% + $H_2F$ 1% | Sincolin L*1) 15% | ← | ← |
| Drum rotation at 50° C. for 60 min. | ← | ← | ← | ← | ← |
| Formic acid 1% pH = 3.5 | ← | ← | Formic acid 1% | ← | ← |
| Drum rotation for 30 min. | ← | ← | Drum rotation for 5 min. | Drum rotation for 30 min. | ← |
| Washing with water | ← | ← | Comp'd (10) 10% | Comp'd (11) 6% | New bath 30° C. Comp'd (12) 3% |
| | | | Drum rotation for 30 min. | Drum rotation for 45 min. | Drum rotation for 30 min. |
| | | | Washing with water | ← | ← |
| Hanging over trestle overnight, drying with suspending, beating, and netting | | | | | |

| Sample No. 7 | Sample No. 8 |
|---|---|
| Sincolin L 15% | Sincolin L 7.5% + EMB 7.5% |
| Drum rotation at 50° C. for 60 min. | ← |
| Formic acid 1% | ← |
| Drum rotation for 5 min. | Drum rotation for 30 min. |
| Comp. (7) 3% | |
| Drum rotation for 30 min. | |
| Washing with water | |
| Hanging over trestle overnight, drying with suspending, beating, and netting | |

Note: *1)Manufactured by Yoshiwara Oil Co., Ltd.

Then, the treated leather was subjected to the various tests as follows:

(1) Feeling

Each leather sample as treated, the leather sample which was wet cleaned according to JIS L 0844 C, or the leather sample which was laundered by dry cleaning according to JIS K 6552 was subjected to the feeling test in the same manner as in Example 2. The results are shown in following Table 2.

TABLE 2

| Leather sample No. | Feeling*1) As treated | After wet cleaning | After dry cleaning A | After dry cleaning B |
|---|---|---|---|---|
| 1 | 4.5 | 4.5 | 4.3 | 4.5 |
| 2 | 2.7 | 1.5 | 2.1 | 2.3 |
| 3 | 4.8 | 4.5 | 4.0 | 4.0 |
| 4 | 3.0 | 2.1 | 2.5 | 2.8 |
| 5 | 3.0 | 1.7 | 2.3 | 2.5 |
| 7 | 4.8 | 4.8 | 4.5 | 4.5 |
| 8 | 3.0 | 1.5 | 1.9 | 2.0 |

Note: *1)Feeling values are average values of 10 panels.

(2) Deep color effect

By ten panels (five men and five women), color tone of the leather samples was evaluated with eyes according to the following criteria:

1: Very light (whitely faded)

3: Normal

5: Very deep color (dark)

The results (average values of ten panels) are shown in Table 3.

TABLE 3

| Leather sample No. | Average value of color tone |
|---|---|
| 1 | 4.8 |
| 2 | 2.0 |
| 3 | 2.0 |
| 4 | 4.7 |
| 5 | 4.5 |
| 6 | 3.5 |
| 7 | 4.7 |
| 8 | 2.9 |

(3) Color fastness (a) According to the sweat test A of JIS L 0804, color fastness of each leather sample was evaluated. The results are shown in Table 4.

TABLE 4

| Condition Staining degree on union cloth | Alkaline Leather sample No. | | Acidic Leather sample No. | |
|---|---|---|---|---|
| No. A | 1 | 6 | 1 | 6 |
| Cotton | 4–5 | 3–4 | 4 | 4 |
| Nylon | 4 | 3 | 4–5 | 3–4 |
| Vinylon | 5 | 4 | 5 | 4 |

TABLE 4-continued

| Condition Staining degree on union cloth | Alkaline Leather sample No. | | Acidic Leather sample No. | |
|---|---|---|---|---|
| No. A | 1 | 6 | 1 | 6 |
| Acetate | 5 | 5 | 5 | 5 |
| Wool | 4–5 | 3–4 | 4–5 | 3–4 |
| Rayon | 5 | 4 | 5 | 4–5 |
| Acryl | 5 | 5 | 5 | 5 |
| Silk | 4 | 3 | 4 | 3 |
| Polyester | 5 | 5 | 5 | 5 |
| Degree of changing in color | 5 | 4–5 | 5 | 4–5 |

(b) According to the cleaning tests of JIS K 6552, color fastness of each leather sample was evaluated. The results are shown in Table 5.

TABLE 5

| Staining degree on union cloth | Wet cleaning Leather sample No. | | Dry cleaning A Leather sample No. | | | Dry cleaning B Leather sample No. | | |
|---|---|---|---|---|---|---|---|---|
| No. A | 1 | 6 | 1 | 6 | 7 | 1 | 6 | 7 |
| Cotton | 5 | 4 | 3–4 | 2 | 3 | 4 | 2–3 | 3–4 |
| Nylon | 5 | 5 | 5 | 4 | 5 | 5 | 2–3 | 5 |
| Vinylon | 5 | 4–5 | 5 | 4 | 5 | 5 | 2–3 | 5 |
| Acetate | 5 | 5 | 5 | 4–5 | 4–5 | 5 | 2–3 | 4–5 |
| Wool | 5 | 4–5 | 4–5 | 2–3 | 4 | 5 | 2–3 | 4–5 |
| Rayon | 5 | 4–5 | 4 | 2–3 | 3–4 | 5 | 2–3 | 4–5 |
| Acryl | 5 | 5 | 5 | 4 | 4–5 | 5 | 2–3 | 4–5 |
| Silk | 5 | 4 | 4–5 | 4–5 | 4 | 5 | 2–3 | 4–5 |
| Polyester | 5 | 5 | 5 | 4 | 5 | 5 | 2–3 | 4–5 |
| Degree of changing in color | 5 | 4–5 | 2–3 | 1–2 | 2 | 2–3 | 1–2 | 2 |

(4) Weather resistance

Weather resistance of each leather sample was evaluated according to JIS L 0842. The results are shown in Table 6.

TABLE 6

| Leather sample No. | Exposure time (hrs) | Degree of changing in color |
|---|---|---|
| 1 | 20 | 4–5 |
| 6 | 20 | 3 |
| 7 | 20 | 4 |

(5) Color fastness to rubbing

Color fastness to rubbing was evaluated according to JIS K 6547. The results are shown in Tale 7.

TABLE 7

| Item | Leather sample No. | Color fastness to rubbing Dry | Wet | Alkaline sweat | Acidic sweat |
|---|---|---|---|---|---|
| Stain (cotton) | 1 | 4–5 | 4–5 | 4–5 | 4–5 |
| | 6 | 3 | 3 | 3 | 3 |
| | 7 | 4 | 4 | 4 | 4 |
| Degree of changing in color | 1 | 5 | 5 | 5 | 5 |
| | 6 | 5 | 4–5 | 4–5 | 4–5 |
| | 7 | 5 | 5 | 5 | 5 |

What is claimed is:

1. A method for preparing a leather modifier having a mixture of the compounds

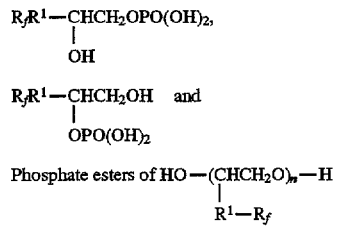

wherein n is an integer of 2 or larger, and $R_f$ and $R^1$ are defined below, comprising the step of reacting an ethylene oxide compound having a fluorine group of the formula

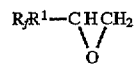

wherein $R_f$ is a $C_3$–$C_{21}$ fluoroalkyl group, fluoroalkenyl group or fluoroether group or a mixture thereof; and $R^1$ is a group of the formula:

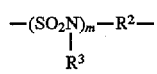

wherein $R^2$ is a $C_1$–$C_{20}$ alkylene group or a phenylenemethylene group, wherein the substituents on the carbon atoms of $R^2$ are hydrogen or halogen atom; $R^3$ is a $C_1$–$C_5$ alkyl or hydroxyalkyl group; and m is 1;

with a phosphorus compound selected from the group consisting of pyrophosphoric acid, polyphosphoric acid and phosphorus pentoxide.

2. The method for preparing a leather modifier according to claim 1, wherein the reaction is carried out by heating the ethylene oxide compound and the phosphorus compound at a reaction temperature from 30°–200° C. for 0.5–15 hours.

3. The method for preparing a leather modifier according to claim 2, wherein the reaction temperature is from 50°–150° C., and the reaction time is from 1–8 hours.

4. The method for preparing a leather modifier according to claim 1, wherein the ratio of the moles of ethylene oxide compound to the moles of phosphorus atom in the phosphorus compound is from 0.3 to 3 moles per mole of phosphorus atom.

5. The method for preparing a leather modifier according to claim 4, wherein the ratio is 0.6 to 2 moles per mole of phosphorous atom.

6. The method for preparing a leather modifier according to claim 1, wherein the phosphorus compound is pyrophosphoric acid.

7. The method for preparing a leather modifier according to claim 6, wherein the reaction is carried out at 110°–115° C. for three hours.

8. A modified tanned leather that has been contacted in a fatting step with a leather modifier in place of or in combination with a fatting agent, wherein said leather modifier comprises a mixture of the compounds $$R_f-R^1-\underset{\underset{OH}{|}}{CH}CH_2OPO(OH)_2,$$

$$R_f-R^1-\underset{\underset{OPO(OH)_2}{|}}{CH}CH_2OH \text{ and}$$

$$\text{Phosphate esters of } HO-(\underset{\underset{R^1-R_f}{|}}{CH}CH_2O)_n-H$$

wherein n is an integer of 2 or greater; $R_f$ is a $C_3$–$C_{21}$ fluoroalkyl group, fluoroalkenyl group or fluoroether group or a mixture thereof; and $R^1$ is a group of the formula:

$$-(\underset{\underset{R^3}{|}}{SO_2N})_m-R^2-$$

wherein $R^2$ is a $C_1$–$C_{20}$ alkylene group or a phenylenemethylene group, wherein the substituents on the carbon atoms of $R^2$ are hydrogen or halogen atom; $R^3$ is a $C_1$–$C_5$ alkyl or hydroxyalkyl group; and m is 1.

9. A process for modifying a leather, which comprises tanning a leather and contacting the tanned leather in a fatting step with a leather modifier in place of or in combination with a fatting agent, wherein said leather modifier comprises a mixture of the compounds $$R_f-R^1-\underset{\underset{OH}{|}}{CH}CH_2OPO(OH)_2,$$

$$R_f-R^1-\underset{\underset{OPO(OH)_2}{|}}{CH}CH_2OH \text{ and}$$

$$\text{Phosphate esters of } HO-(\underset{\underset{R^1-R_f}{|}}{CH}CH_2O)_n-H$$

wherein n is an integer of 2 or greater, and $R_f$ and $R^1$ are defined below, and is produced by reacting an ethylene oxide compound having a fluorine group of the formula:

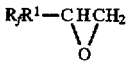

wherein $R_f$ is a $C_3$–$C_{21}$ fluoroalkyl group, fluoroalkenyl group or fluoroether group or a mixture thereof; and $R^1$ is a group of the formula:

$$-(\underset{\underset{R^3}{|}}{SO_2N})_m-R^2-$$

wherein $R^2$ is a $C_1$–$C_{20}$ alkylene group or a phenylenemethylene group wherein the substituents on the carbon atoms of $R^2$ are hydrogen or halogen atom; $R^3$ is a $C_1$–$C_5$ alkyl or hydroxyalkyl group; and m is 1;

with a phosphorus compound selected from the group consisting of pyrophosphoric acid, polyphosphoric acid and phosphorus pentoxide.

10. The process for modifying a leather according to claim 9, wherein 100–200% by weight of the leather modifier based on the weight of the leather is used in the fatting step.

11. The process for modifying a leather according to claim 10, wherein the fatting step is carried out at a temperature of 20°–60° C. for 30–90 minutes.

12. A leather modifier that is produced by reacting an ethylene oxide compound having a fluorine group selected from the group consisting of

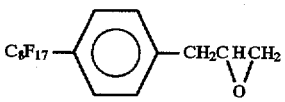

and

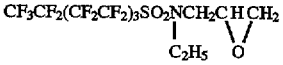

with a phosphorus compound selected from the group consisting of pyrophosphoric acid, polyphosphoric acid and phosphorus pentoxide; at a reaction temperature from 30°–200° C. for 0.5–15 hours; and the ratio of the moles of ethylene oxide compound to the moles of phosphorus atom in the phosphorus compound is from 0.3 to 3 moles per mole of phosphorus atom.

13. A leather modifier that is produced by reacting an ethylene oxide compound having the formula

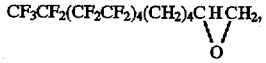

with a phosphorus compound selected from the group consisting of pyrophosphoric acid, polyphosphoric acid and phosphorus pentoxide; at a reaction temperature from 30°–200° C. for 0.5–15 hours; and the ratio of the moles ethylene oxide compound to the moles of phosphorus atom in the phosphorus compound is from 0.3 to 3 moles per mole of phosphorus atom.

* * * * *